US005875822A

United States Patent [19]

Fargeout

[11] Patent Number: 5,875,822

[45] Date of Patent: Mar. 2, 1999

[54] POLYAMIDE SPIRAL SEAM FOR SEAMED PAPERMAKERS' FABRICS

[75] Inventor: Patrick Fargeout, Riberac, France

[73] Assignee: Albany International Corp., Albany, N.Y.

[21] Appl. No.: 673,668

[22] Filed: Jun. 25, 1996

[51] Int. Cl.[6] ..... D03D 3/04; D03D 15/00; F16G 3/02; D21F 7/10

[52] U.S. Cl. ..... 139/383 AA; 24/33 C; 162/904; 428/222

[58] Field of Search ..... 139/383 AA; 428/222; 24/33 P, 33 C, 573.7; 162/904

[56] References Cited

U.S. PATENT DOCUMENTS

| | | | |
|---|---|---|---|
| 4,381,612 | 5/1983 | Shank | 139/383 AA |
| 4,862,926 | 9/1989 | Barrette et al. | 139/383 AA |
| 4,896,702 | 1/1990 | Crook | 139/383 AA |
| 5,005,610 | 4/1991 | Davenport | 139/383 AA |
| 5,204,150 | 4/1993 | Davenport | 139/383 AA |
| 5,391,419 | 2/1995 | Davenport | 139/383 AA |

*Primary Examiner*—Andy Falik
*Attorney, Agent, or Firm*—Kane, Dalsimer, Sullivan, Kurucz, Levy, Eisele and Richard, LLP

[57] ABSTRACT

An on-machine-seamable (OMS®) papermakers' fabric produced by modified endless weaving includes machine-direction (MD) and cross-machine direction (CD) yarns. The MD yarns are plied/twisted yarns, and weave continuously back-and-forth between the two widthwise edges of the fabric, each time forming a seaming loop at one of the two widthwise edges. A seaming spiral, a monofilament spiral preferably extruded from a polyamide resin, is attached to the seaming loops at each of the two widthwise edges. The two seaming spirals are used to join the fabric into endless form with a pin seam. In this way, an OMS® papermakers' fabric, having plied/twisted yarns in the machine direction is provided with monofilament joining means which maintain proper orientation and shape for the ready pin seaming of the fabric on a papermachine.

12 Claims, 3 Drawing Sheets

POLYAMIDE SPIRAL SEAM FOR SEAMED PAPERMAKERS' FABRICS

BACKGROUND OF THE INVENTION

1. Field of the Invention

The present invention relates to the papermaking arts. More specifically, the present invention is a papermakers' fabric of the on-machine-seamable (OMS®) variety, such as an OMS® press fabric for the press section of a papermachine.

2. Description of the Prior Art

During the papermaking process, a fibrous web is formed by depositing a fibrous slurry, that is, an aqueous dispersion of cellulose fibers, on a moving forming fabric in the forming section of a papermachine. A large amount of water is drained from the slurry through the forming fabric during this process, leaving the fibrous web on the surface of the forming fabric.

The newly formed web proceeds from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom, and which adhere the fibers in the web to one another to turn the fibrous web into a sheet. The water is accepted by the press fabric or fabrics and, ideally, does not return to the web.

The web finally proceeds to a dryer section, which includes at least one series of rotatable dryer drums or cylinders, which are internally heated by steam. The web, or newly formed paper sheet, itself is directed in a sinuous path sequentially around each in the series of drums by a dryer fabric, which holds the web closely against the surfaces of the drums. The heated drums reduce the water content of the web to a desirable level through evaporation.

It should be appreciated that the forming, press and dryer fabrics all take the form of endless loops on the papermachine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

Referring, for the moment, specifically to press fabrics, it should be recalled that, at one time, press fabrics were supplied only in endless form. This is because a newly formed paper sheet is extremely susceptible to marking in the press nip by any nonuniformity in the press fabric or fabrics. An endless, seamless fabric, such as one produced by the process known as endless weaving, has a uniform structure in both its longitudinal (machine) and transverse (cross-machine) directions. A seam, such as a seam which may be used to close the press fabric into endless form during installation on a papermachine, represents a discontinuity in the uniform structure of the press fabric. The use of a seam, then, greatly increases the likelihood that the paper sheet will be marked in the press nip.

In brief, the seam region of any workable on-machine-seamable (OMS®) press fabric must behave under load, that is, under compression in the press nip or nips, like the rest of the press fabric, and must have the same permeability to water and to air as the rest of the press fabric, in order to prevent the periodic marking of the paper product being manufactured by the seam region. OMSO® is a registered trademark of Albany International Corp.

Despite the considerable technical obstacles presented by these requirements, it remained highly desirable to develop an on-machine-seamable (OMS®) press fabric, because of the comparative ease and safety with which it could be installed on the press section. Ultimately, these obstacles were overcome with the development of press fabrics having seams formed by providing seaming loops on the crosswise edges of the two ends of the fabric. The seaming loops themselves are formed by the machine-direction (MD) yarns of the fabric. A so-called "pin-seam" is formed by bringing the two ends of the press fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less time-consuming to install an OMS® press fabric, than it is to install an endless press fabric, on a papermachine.

One method to produce a press fabric that can be joined on the papermachine with a "pin seam" is to flat-weave the fabric. In this case, the warp yarns are the machine-direction (MD) yarns of the press fabric. To form the seaming loops, the warp ends are woven some distance back into the fabric body in a direction parallel to the warp yarns. Another technique, far more preferable, is a modified form of endless weaving, which normally is used to produce an endless loop of fabric. In modified endless weaving, the weft, or filling, yarns are continuously woven back and forth across the loom, in each passage forming a loop on one of the edges of the fabric being woven by passing around a loop-forming pin. As the weft yarn, or filling yarn, which ultimately becomes the MD yarn in the press fabric, is continuous, the seaming loops obtained in this manner are stronger than any that can be produced by weaving the warp ends back into the ends of a flat-woven fabric.

Originally, single monofilament strands were used in both the machine and cross-machine directions of OMS® press fabrics. The relative stiffness of monofilament ensures that it will have the requisite good seaming-loop formation properties. Experience showed, however, that single monofilament strands are difficult to weave and have insufficient elasticity in the machine direction for many kinds of contemporary presses. Tensile failure and seam breakage were frequently observed.

Another difficulty is presented by the very open, rigid, incompressible structure of base fabrics woven from single monofilament. For some papermaking applications, this incompressibility is not a problem, and may even be ideal. However, for positions that have poor auxiliary fabric dewatering capacity, or produce mark-sensitive paper grades, a softer, more compressible base fabric is needed.

A more compressible base fabric may be obtained by weaving with multifilament or plied monofilament yarns, instead of with single monofilament strands. However, yarns of these types do not have the rigidity necessary for good loop formation or for maintaining the integrity of the seam area during loop meshing when the seam is to be closed. Moreover, because yarns of these types are twisted, loops formed from them tend to rotate about axes lying in the planes of the loops. When this rotation, known as the secondary helix effect, occurs, it causes the loops to depart from the ideal orientation needed to form the pin seam. Such departure makes it difficult, if not impossible, to properly interdigitate the loops at each end of the press fabric during closure, as well as to direct the pintle through the passage defined by the interdigitated loops.

Various attempts have been made in the prior art to overcome these difficulties by making the loop-forming MD yarns act like monofilament. In U.S. Pat. No. 5,005,610, the MD yarns in an OMS® Papermakers' fabric have a composite structure including braided monofilament strands. The braided yarn forms seaming loops which resist deformation and, because they are balanced with regard to twist, form seaming loops which are not susceptible to "secondary helix effects" rotation from the ideal plane geometry of the seam.

In U.S. Pat. No. 5,204,150, the MD yarns in an OMS® papermakers' fabric are plied/twisted yarns extruded from a resin which partially melts during the heat-setting of the fabric, giving the MD yarns a monofilament-like character. Even though not balanced due to the twising and plying, the fusion caused by the partial melting of the individual ends prevents loop rotation from the ideal seam geometry.

Finally, in U.S. Pat. No. 5,391,419, the MD yarns of a pin-seamable papermakers' fabric are plied/twisted yarns having a coating which gives the yarn a monofilament-like structure. The coating may be either permanent, semi-permanent or soluble. Even though the yarns may not be balanced, the coating prevents loop rotation.

The present invention is a different approach for providing an OMS® papermakers' fabric having plied/twisted MD yarns with monofilament-like seaming loops.

SUMMARV OF THE INVENTION

Accordingly, the objective of the present invention is to provide an OMS® papermakers' fabric having plied/twisted MD yarns with monofilament seaming loops. By a plied/twisted yarn is meant any variety of yarn used in the production of papermachine clothing that has multiple ends or filaments, that are twisted to a desired degree, and, in many cases, then combined or plied with other filaments of the same type or of a different type. During the plying operation, the yarn components are combined together by twisting them in the opposite direction from that of the individual components. The plied/twisted yarns may accordingly be considered to be multicomponent yarns.

This objective is met with the present OMS® papermakers' fabric which is woven in a modified endless weaving technique from a system of MD yarns and a system of cross-machine direction (CD) yarns, wherein the MD yarns are plied/twisted yarns, such as multifilament or plied monofilament yarns. The papermakers' fabric has a rectangular shape with a length, a width, two lengthwise edges and two widthwise edges.

The plied/twisted MD yarns extend back-and-forth continuously for the length of the papermakers' fabric between the two widthwise edges, at each widthwise edge forming a plurality of seaming loops. The seaming loops, formed from plied/twisted yarns, are susceptible to the problems discussed above, and tend to depart from a preferred orientation and shape as soon as the loop-forming pin, about which they are formed during the modified endless weaving process, is removed.

According to the present invention, concurrent with the removal of the loop-forming pin, monofilament seaming spirals are interdigitated with and joined to the seaming loops at each widthwise edge of the fabric, before the seaming loops have a chance to depart from preferred orientation and shape. The monofilament seaming spirals are then used to close the fabric into endless form on a papermachine with a pin seam.

The present invention will now be described in more full and complete detail, with reference being made to the figures which may be identified as follows.

DETAILED DESCRIPTION OF THE PREFERRED EMBODIMENT

Figure 1:
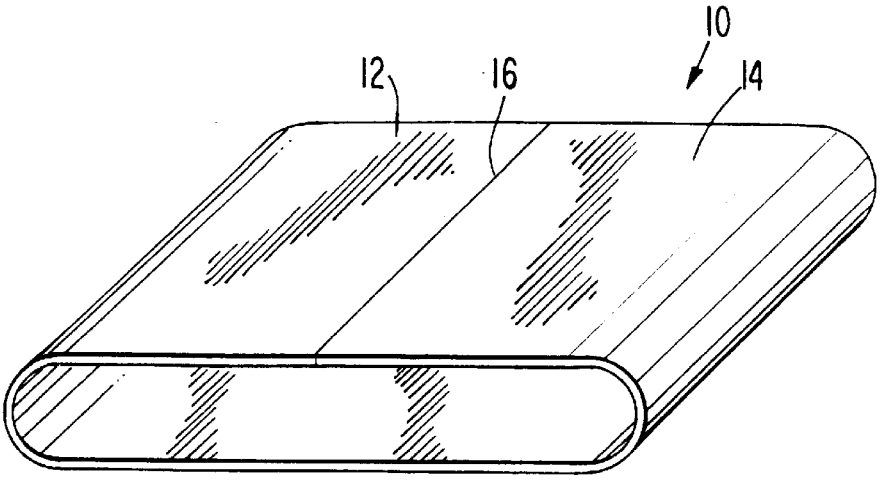
FIG. 1 is a schematic perspective view of an on-machine-seamed (OMS®) press fabric.

Turning now specifically to the figures, FIG. 1 is a schematic perspective view of an on-machine-seamed (OMS®) papermakers' fabric 10. The fabric 10 takes the form of an endless loop once its two ends 12, 14 have been joined to one another at seam 16.

Figure 2:
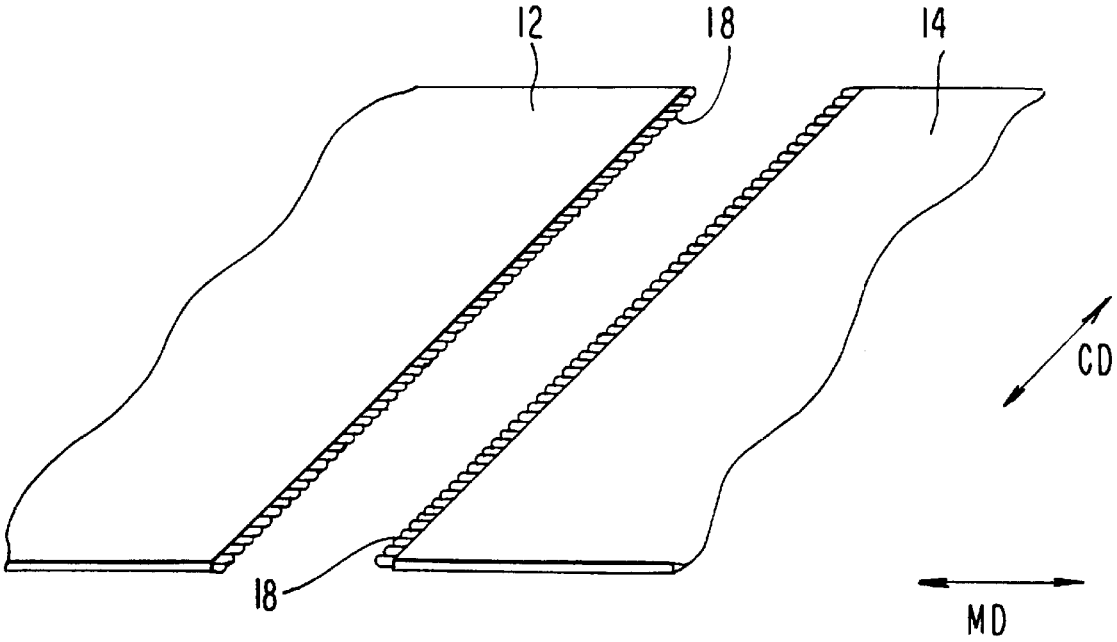
FIG. 2 is a schematic perspective view of the two ends of the OMS® press fabric prior to their being joined to one another.

FIG. 2 is a schematic perspective view of the two ends 12, 14 of the OMS® fabric 10 prior to their attachment to one another. Widthwise across the edges of each of the two ends 12, 14 are a plurality of seaming loops 18. To attach the two ends 12, 14 to one another, they are brought together, in so doing alternating and intermeshing, or interdigitating, the seaming loops 18 at each end with one another. The interdigitated seaming loops 18 define a passage through which a pin, or pintle, a yarn-like strand or member, may be directed to secure the ends 12, 14 to one another. Herein lies the origin of the term "pin seam".

Figure 3:
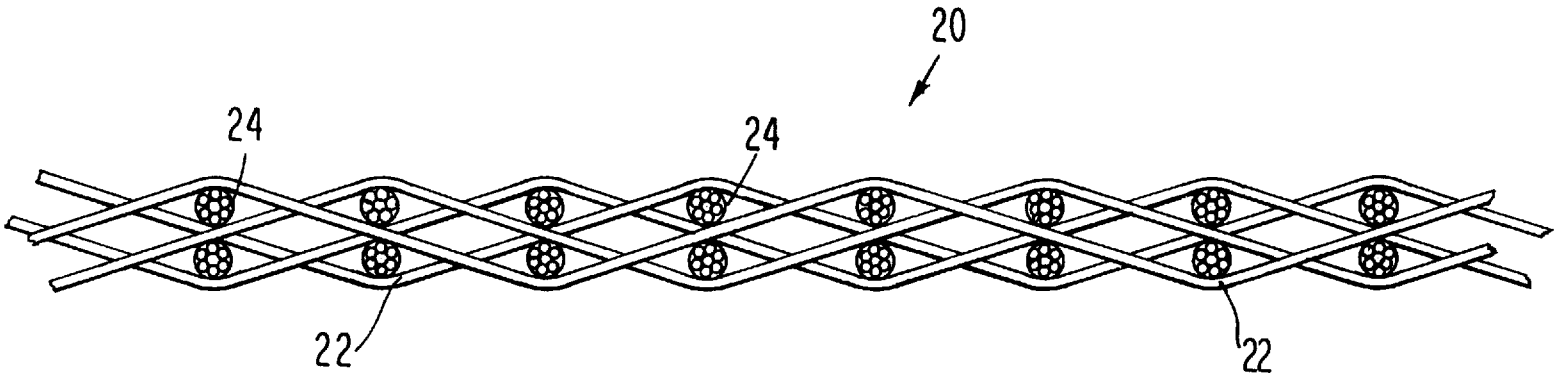
FIG. 3 is a cross-sectional view, taken in the warpwise direction of a papermakers' fabric.

In the present invention, the seaming loops 18 are provided in a new and unique way. FIG. 3 shows a cross section, taken in the warpwise direction, of. a papermakers' fabric 20 on which the present invention may be practiced. Fabric 20 is shown to be woven in a duplex weave, although it should be understood that such a weave is shown as an example only, and that the invention could be practiced with fabrics 20 that are woven in single-layer weaves, or which are laminated and include several fabric layers. Fabric 20 may be a base fabric for a press fabric, and accordingly may be needled with one or more layers of staple fiber batt material on one or both sides, or may be coated in some manner. Alternatively, fabric 20 may be used on one of the other sections of the papermachine, that is, on the forming or drying sections, or as a base for a polymeric resin-coated, paper-industry process belt.

Fabric 20 is woven in a modified endless weaving process. In such a situation, warp yarns 22 ultimately become the cross-machine direction (CD) yarns, and the weft yarns 24 ultimately become the machine-direction (MD) yarns, when reference is made to the directions of the yarns relative to the papermachine on which fabric 20 is installed.

Warp yarns 22, the CD yarns in the OMS® fabric 20, may be of any of the yarn types used to weave papermachine clothing. That is to say, monofilament yarns, which are monofilament strands used singly, or plied/twisted yarns, in the form of plied monofilament or plied multifilament yarns, may be used as warp yarns 22.

Weft yarns 24, the MD yarns in the OMS® fabric 20, on the other hand, are plied/twisted yarns. In the present context, as defined above, these yarns may be multifilament yarns or plied monofilament yarns; that is to say, these yarns may be any of the continuous filament yarn forms except monofilament yarns used singly or alone. For example, weft yarns 24 may be plied monofilament yarns of one of the following two types:

a) 0.26 mm×1×3, three strands of 0.26 mm-diameter yarn individually twisted, and then plied together by twisting about one another in the opposite direction; or b) 0.30 mm×1×3, three strands of 0.30 mm-diameter yarn individually twisted, and then plied together by twisting about one another in the opposite direction.

In addition, weft yarns 24 may be spun yarns (yarns spun from staple fibers) or combination yarns, wherein yarns of more than one of the above-mentioned varieties are combined with one another by plying, twisting or both. Further, weft yarns 24 may be a multistrand yarn comprising a plurality of single filaments plied/twisted together, each filament having a diameter in the range from 0.05 mm to 0.15 mm. For example, a multistrand yarn may comprise three bundles each comprising eight strands of 0.10 mm-diameter yarn twisted about one another in one direction, the three bundles being twisted about one another in the opposite direction (0.10 mm×8×3).

In any event, the filaments comprising warp yarns 22 (CD yarns) and weft yarns 24 (MD yarns) are extruded from synthetic polymeric resin materials, such as polyamide, polyester, polyetherketone, polypropylene, polyaramid, polyolefin and polyethylene teraphthalate (PET) resins, and incorporated into yarns according to techniques well-known in the textile industry and particularly in the papermachine clothing industry.

In the weaving of fabric 20 by modified endless weaving, the weft yarns 24 are continuously woven back and forth across the loom, in each passage thereacross forming a loop on one of the edges of the fabric 20 being woven by passing around a loop-forming pin. Several schemes, disclosed and claimed in U.S. Pat. No. 3,815,645 to Codorniu, the teachings of which are incorporated herein by reference, for weaving OMS® fabrics by modified endless weaving are available and may be used in the practice of the present invention.

Figure 4:
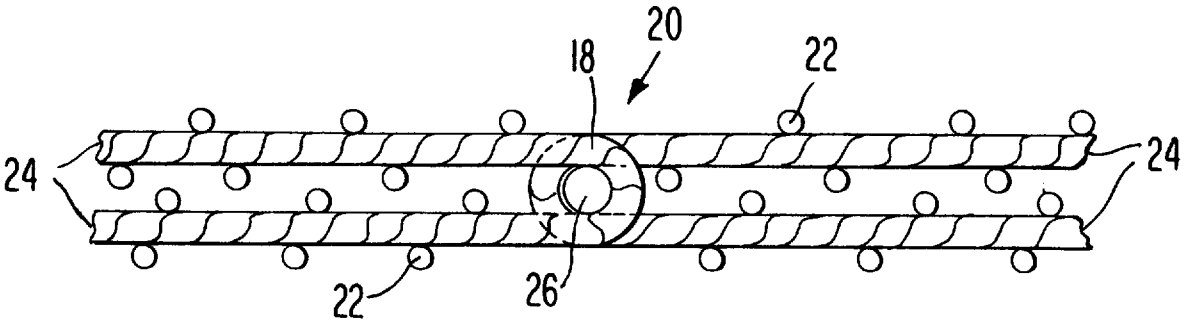
FIG. 4 is a cross-sectional view, taken in the weftwise direction, of the seam region of the fabric prior to the removal of a loop-forming pin therefrom.

FIG. 4 is a cross section, taken in the weftwise direction, of the seam region of fabric 20 taken at the conclusion of the modified endless weaving process. Weft yarns 24, ultimately the MD yarns in fabric 20, weave around loop-forming pin 26 in a continuous manner to provide seaming loops 18.

It will be appreciated that loop-forming pin 26 must be removed to place fabric 20 into a form in which it may readily be installed on a papermachine. It will also be appreciated that, because weft yarns 24 (MD yarns) are plied/twisted yarns, seaming loops 18 may rotate from the ideal seam loop geometry, illustrating the secondary helix effect, and deform as soon as the loop-forming pin 26 is removed, rendering subsequent seaming on the papermachine difficult or impossible.

Figure 5:
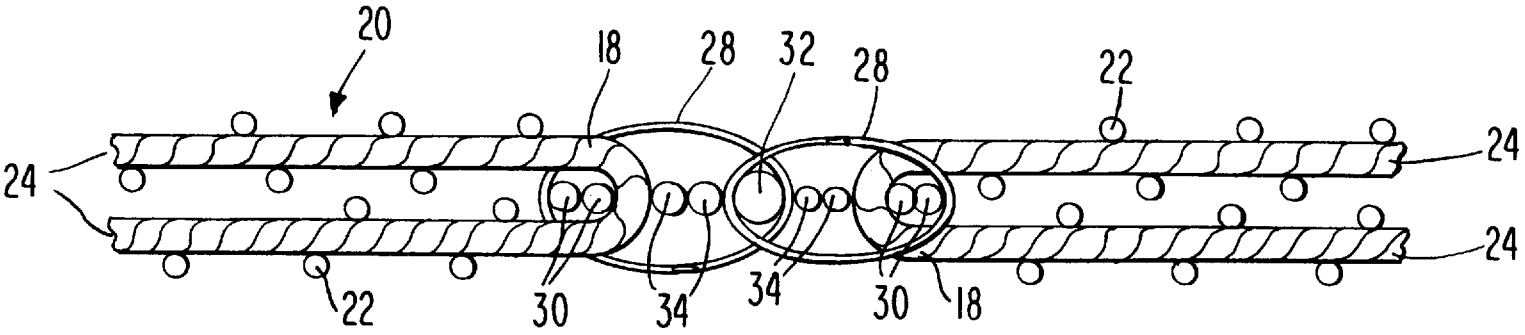
FIG. 5 is a cross-sectional view, taken in the machine direction, of the seam region of the fabric following its installation on a papermachine.

FIG. 5 is a cross section, taken in the machine direction, of the seam region of fabric 20 taken upon installation on a papermachine. The problem of joining the ends of a fabric having seaming loops 18 formed by plied/twisted yarns is solved by attaching seaming spirals 28 to the seaming loops 18 concurrently with the removal of the loop-forming pin 26.

Specifically, as loop-forming pin 26 is pulled out from the passage defined by interdigitated seaming loops 18, a seaming spiral 28 is attached to each seaming loop 18 as soon as loop-forming pin 26 is withdrawn and before the seaming loop 18 has a chance to deform or rotate from its preferred orientation. Seaming spirals 28 are therefore interdigitated with seaming loops 18 one-by-one as loop-forming pin 26 is withdrawn. Seaming spirals 28 are joined to seaming loops 18 by connecting yarns 30, which are directed through seaming loops 18 as soon as seaming spirals 28 are in place. At the conclusion of this process, one has obtained an OMSO® fabric 20 having plied/twisted yarns in the machine direction and monofilament seaming loops provided by seaming spirals 28.

One or more layers of staple fiber batt, not shown in FIG. 5, are customarily needled into fabric 20. Preferably, this is done before loop-forming pin 26 is removed from seaming loops 18 and seaming spirals 28 are installed, although the order of these operations may be reversed. However, where seaming spirals 28 are installed prior to needling, the needling operation itself may cause them damage and require their replacement. Needling before the removal of loop-forming pin 26 is preferred for this reason.

Seaming spirals 28 are monofilament spirals, preferably of extruded polyamide resin. The monofilament diameter may be, for example, 0.40 mm or 0.50 mm. During the installation of fabric 20 on a papermachine, seaming spirals 28, being of monofilament, may be readily interdigitated with one another and joined to one another by directing pintle 32 through the passage defined by the interdigitated spirals. Stuffer yarns 34 may be inserted within the seaming spirals 28 to ensure that the seam region has the same characteristics as the rest of the fabric 20. Connecting yarns 30 and stuffer yarns 34 may be yarns of the same types used as the warp yarns 22 (CD yarns) of the fabric 20. Pintle 32 may be a single strand of monofilament, multiple strands of monofilament untwisted about one another, or plied, twisted, braided or knitted together, or one or more strands of any of the plied/twisted yarns described above for use as the MD yarns (weft yarns 24) of fabric 20. Pintle 32 may be a single strand of monofilament, multiple strands of monofilament, multiple strands of monofilament untwisted about one another, or plied, twisted braided or knitted together, or one or more strands of any of the plied/twisted yarns described above for use as the MD yarns (weft yarns 24) of fabric 20.

Modifications to the above would be obvious to those of ordinary skill in the art, but would not bring the invention so modified beyond the scope of the appended claims.

What is claimed is:

1. An on-machine-seamable papermakers' fabric, closable into endless form with a pin seam, comprising:

a system of machine-direction (MD) yarns and a system of cross-machine direction (CD) yarns, said yarns of said system of MD yarns being interwoven with said yarns of said system of CD yarns by a modified endless weaving technique to form said papermakers' fabric in a rectangular shape with a length, a width, two lengthwise edges, and two widthwise edges, said MD yarns extending back-and-forth continuously for said length of said papermakers' fabric between said two widthwise edges, said MD yarns further forming seaming loops along each of said two widthwise edges, said MD yarns being plied/twisted yarns, said plied/twisted yarns therefore forming said seaming loops;

a first seaming spiral interdigitated with said seaming loops at one of said two widthwise edges of said papermakers' fabric and attached thereto by at least one connecting yarn extending in a cross-machine direction; and a second seaming spiral interdigitated with said seaming loops at the other of said two widthwise edges of said papermakers' fabric and attached thereto by at least one connecting yarn extending in a cross-machine direction, whereby said papermakers' fabric is joined into endless form by interdigitating said first and second seaming spirals and by directing a pintle through the passage defined by the interdigitated seaming spirals to form a pin seam.

2. A papermakers' fabric as claimed in claim 1 wherein said first and second seaming spirals are monofilament spirals.

3. A papermakers' fabric as claimed in claim 2 wherein said monofilament spirals are extruded from a polyamide resin.

4. A papermakers' fabric as claimed in claim 1 wherein said plied/twisted yarns are multifilament yarns.

5. A papermakers' fabric as claimed in claim 1 wherein said plied/twisted yarns are plied monofilament yarns.

6. A papermakers' fabric as claimed in claim 1 wherein said plied/twisted yarns are multistrand yarns comprising a plurality of single filaments, each filament having a diameter in the range from 0.05 mm to 0.15 mm.

7. A papermakers' fabric as claimed in claim 1 wherein said plied/twisted yarns are spun yarns.

8. A papermakers' fabric as claimed in claim 1 wherein said plied/twisted yarns are combination yarns.

9. A papermakers' fabric as claimed in claim 1 wherein said plied/twisted yarns include filaments extruded from a polymeric resin material.

10. A papermakers' fabric as claimed in claim 9 wherein said polymeric resin material is selected from the group consisting of polyamide, polyester, polyetherketone, polypropylene, polyaramid, polyolefin and polyethylene terephthalate (PET) resins.

11. A papermakers' fabric as claimed in claim 1 further comprising at least one stuffer yarn within said first seaming spiral.

12. A papermakers' fabric as claimed in claim 1 further comprising at least one stuffer yarn within said second seaming spiral.

* * * * *